US006043600A

United States Patent [19]

Sica

[11] Patent Number: 6,043,600

[45] Date of Patent: Mar. 28, 2000

[54] CURVED SHATTER-RESISTANT LAMP ASSEMBLY AND METHOD

[75] Inventor: Michael F. Sica, Greenwich, Conn.

[73] Assignee: Royal Lite Manufacturing & Supply Corp., Belleville, N.J.

[21] Appl. No.: 09/022,987

[22] Filed: Feb. 12, 1998

Related U.S. Application Data

[63] Continuation-in-part of application No. 08/921,898, Sep. 2, 1997.

[51] Int. Cl.[7] ..... H01J 17/18

[52] U.S. Cl. ..... 313/493; 313/498; 313/112

[58] Field of Search ..... 313/110, 116, 313/318.01, 318.12, 324, 483, 484, 485, 493, 623, 624, 634, 25, 635, 258, 486, 489, 112; 220/7.1; 362/223, 216, 260, 311

[56] References Cited

U.S. PATENT DOCUMENTS 5,173,637 12/1992 Sica .
5,536,998 7/1996 Sica .

FOREIGN PATENT DOCUMENTS

WO 99/12186 3/1999 European Pat. Off. .
2642397 1/1989 France .
61-107 653 5/1986 Japan .
01 169864 7/1989 Japan .

*Primary Examiner*—Vip Patel
*Assistant Examiner*—Matthew J Gerike
*Attorney, Agent, or Firm*—Whitman Breed Abbott & Morgan, LLP; Barry Evans, Esq.

[57] ABSTRACT

A shatter-resistant lamp assembly is formed by encasing a cylindrical lamp bulb in a seamless non-frangible sleeve that is sealed at each end to one end of the lamp. A straight lamp assembly is made by applying an adhesive to each end of a straight lamp bulb, preferably by wrapping double-sided adhesive transfer tape around each metal end cap of the lamp bulb, inserting the bulb into the sleeve with the ends of the sleeve overlapping the tape wound on each end of the bulb, and compressing the ends of the sleeve onto the tape by heat-sealing. A curved lamp assembly is formed by molding two halves of a curved sleeve with contours to fit the curved lamp bulb. Adhesive is applied to the ends of the curved lamp bulb, the two halves of the sleeve are fastened together with adhesive or by ultrasonic bonding, and the ends of the sleeve are attached to the ends of the bulb by the same means as that used for the straight lamp assembly.

9 Claims, 2 Drawing Sheets

FIG. 2
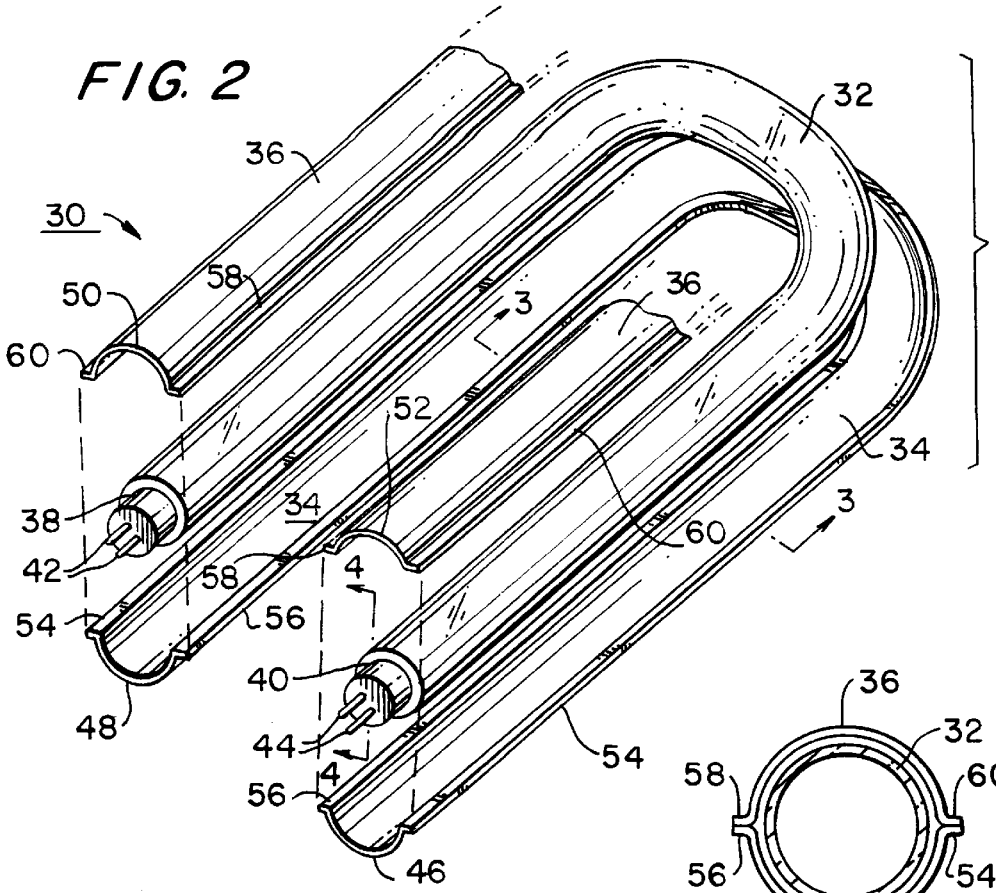
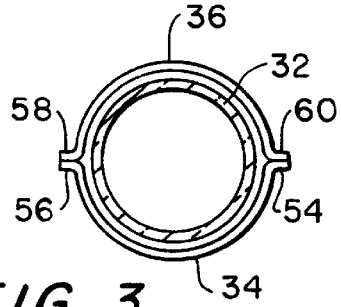
FIG. 3
FIG. 4
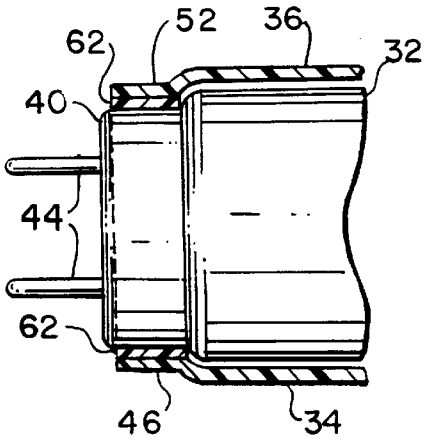
FIG. 5
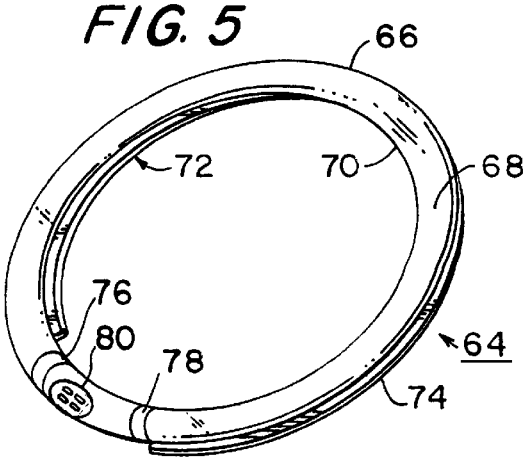

CURVED SHATTER-RESISTANT LAMP ASSEMBLY AND METHOD

This invention relates to shatter-resistant electric lamps and methods of making such lamps. This is a continuation-in-part of U.S. patent application Ser. No. 08/921,898, filed Sep. 2, 1997. This continuation-in-part application relates particularly to curved shatter-resistant lamps.

BACKGROUND OF THE INVENTION

When a conventional fluorescent lamp breaks, fragments of the glass tube, mercury, and phosphor powders from the lamp can scatter to contaminate a wide area. Such contamination is particularly damaging in areas where food is stored uncovered and to food preparation surfaces.

To reduce the possibility of scattered contamination by a broken fluorescent lamp, shatter-resistant lamp assemblies have been developed to contain the contents of a lamp when it breaks. Known lamp assemblies are shown in U.S. Pat. No. 4,048,537 (Blaisdell et al.), U.S. Pat. No. 4,924,368 (Northrop, et al.), U.S. Pat. No. 5,536,998 (Sica), and U.S. Pat. No. 5,173,637 (Sica). The Sica patents are owned by the assignee of the present invention.

The prior art protective assemblies for fluorescent lamps include special molded plastic end fittings that fit onto the terminal caps of the lamp and hold in place a protective sleeve encasing the lamp.

In some of the prior art devices, end fittings are intentionally designed to be removed from one lamp and reused on other lamps. This is very unsatisfactory and results in leakage and contamination by the lamp contents which escape when the lamp is broken.

The assemblies shown in the two Sica patents are a great improvement, the end fittings are sealed to the protective sleeve and to the lamp itself so that there is little leakage or contamination; the lamp contents are sealed in the sleeve.

A significant disadvantage of the three-component protective assemblies, i.e., sleeve and two end fittings, is the difficulty and expense of making them. The two end fittings can be relatively expensive to make, and the dimensions of the end fittings and sleeves should be matched to within relatively close tolerances to ensure a tight fit. Also, there are four seals to be formed, and the greater the number of seals, the greater the chances for leakage.

A long-standing problem with the three-component construction is that it gives the lamp bulbs an unnatural appearance and this, in turn, tends to impede their sales.

One prior proposal to solve this problem is to coat the entire bulb with a protective coating. However, this is unsatisfactory, in that the coating can reduce the useful light output from the bulb, and can become discolored with age, thus adding to the unsightliness.

In typical prior methods, a plastic sleeve is slipped over a straight fluorescent bulb and is sealed at its ends to the ends of the fluorescent bulb.

Special problems are caused by the curved shape of bulbs such as U-shaped and circular fluorescent bulbs. Whenever there is any significant curvature to the bulb, the prior methods are impractical.

OBJECTS OF THE INVENTION

In view of the foregoing, an object of the present invention is to provide a shatter-resistant lamp assembly and method which overcome or alleviate the foregoing problems. In particular, it is an object of the invention to provide such an assembly which has a minimum of separate parts and seams, has no unsightly seams, is transparent to desirable light, and does not discolor with heat and/or age.

Another object of the present invention is to provide such a device that is structurally simpler, more readily adaptable to automated or semi-automated manufacture, and can be made at a lower cost than prior devices.

A further object of the invention is to provide a manufacturing method for making the lamp assembly efficiently and with high quality, while producing a superior product.

Another of the objectives of the present invention is to provide a lamp assembly and method which is effective to provide curved lamp bulb with a shatter-resistant protective transparent cover or sleeve.

Another object of the invention is to provide such a curved lamp assembly which is relatively easy and inexpensive to make and use, and in which the bulb has a shatter-resistant covering with a relatively long life and which transmits light with little alteration or attenuation.

SUMMARY OF THE INVENTION

The foregoing objects are met, in accordance with the present invention, by the provision of a lamp assembly which includes an elongated lamp having a first end and a second end; a non-frangible sleeve substantially encasing the lamp and having two ends which are sealed directly to the ends of the lamp.

Preferably, the ends of the sleeve are adhered to the end caps of the bulb. If the end caps are of smaller diameter than the bulb, the ends of the sleeve are compressed onto the end caps and adhesive is used to secure the sleeve ends to the end caps. The compression preferably is provided by means of heat-shrinking.

Preferably, the adhesive is applied by the use of an adhesive transfer tape which has an adhesive coating on each of its opposed surfaces, together with compression, preferably provided by heat shrinking the ends of the sleeve onto the end caps.

Each sleeve end adheres to the outer layer of adhesive on the transfer tape, and the tape adheres to the bulb end. It is believed that the heat shrinking crimps the sleeve material, reduces the diameter of and shapes the sleeve end to fit on to the bulb end, and presses the sleeve material and tape together so that the adhesive fills any creases in the sleeve material and tightly secures and seals the sleeve to the bulb ends.

The resulting assembly is tightly sealed but has seams only at the end caps, where the visibility of the seams is low. It is a relatively simple, good-looking, shatter-resistant lamp.

It is also preferred that the adhesive be resistant to deterioration at relatively high temperatures, such as 180° F. for an extended length of time.

The tape used preferably is a relatively soft acrylic tape with relatively high-tack adhesive.

Use of such double-sided adhesive tape greatly facilitates the manufacturing method. The tack and dimensions of the adhesive layer used can be controlled easily, and the tape is readily adaptable to being applied by automated or semi-automated equipment.

In accordance with the present invention, the foregoing objectives are met by the further provision of a curved lamp assembly in which two separate sleeve sections are provided. The sections are curved to conform to the shape of the lamp bulb. The two sleeve portions are assembled around the bulb and attached to one another along seams, and the ends of the sleeve thus formed are attached to the ends of the bulb.

Preferably, the ends of the sleeve are attached to the ends of the bulb by the method described above for a straight lamp assembly, in which an adhesive, preferably in the form of a double-sided tape, is applied to the ends of the bulb and the ends of the sleeve are compressed onto the adhesive.

Preferably, the sleeve sections have flanges at their edges, and the two portions of the sleeve are bonded together along flanges by use of adhesives or ultrasonic bonding.

Preferably, the sleeve portions are molded out of the same thermoplastic resin as that used for the straight sleeve described above.

Other objects, aspects, features, and advantages of the present invention will be set forth in or become apparent from the following detailed description and the drawings.

BRIEF DESCRIPTION OF THE DRAWINGS

FIG. 2 is an exploded perspective view of a curved, U-shaped lamp assembly constructed in accordance with the present invention;

FIG. 3 is a cross-sectional view taken along line 3—3 of FIG. 2;

FIG. 4 is a cross-sectional view taken along line 4—4 of FIG. 2; and FIG. 5 is a perspective view of a circular lamp assembly constructed in accordance with the present invention.

DETAILED DESCRIPTION OF THE PREFERRED EMBODIMENTS

Figure 1:
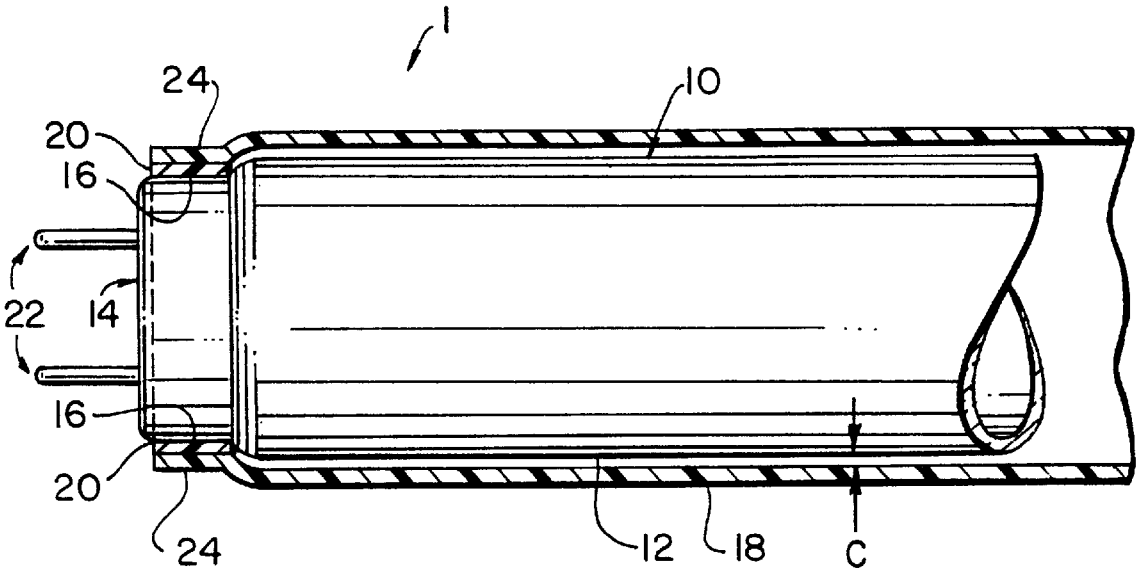
FIG. 1 is a side elevation view, partially broken-away and partially cross-sectional, of a straight shatter-resistant lamp assembly constructed in accordance with the present invention.

FIG. 1 illustrates one end of a shatter-resistant lamp assembly 1. The other end of the assembly (not shown) is simply a mirror image of the end shown.

Lamp assembly 1 comprises a conventional straight fluorescent lamp bulb 10, a protective sleeve 18, and pressure-sensitive adhesive 20. Lamp bulb 10 includes a substantially cylindrical glass tube 12 that tapers slightly at each end and is terminated with a cup-like metal end cap 14 having a peripheral flange portion 16 of a diameter less than that of the tube 12. Cap 14 contains a conventional lamp base portion (not shown) coupled to conventional electrical contact prongs or electrodes 22. Any conventional contact apparatus can be used, such as a single prong connector, a recessed double contact connector, etc.

The lamp bulb 10 is inserted into the sleeve 18, and the ends 24 of the sleeve are compressed, preferably by heat-shrinking, to make intimate contact with the adhesive 20 to seal the ends of the sleeve onto the flanges 16.

Protective sleeve 18 preferably is a non-frangible transparent heat-shrinkable polymer sleeve, such as a polycarbonate sleeve, for example. A particularly suitable transparent, heat-shrinkable tubular polycarbonate material is sold by 3M, Inc. under the designation PC-3207, T-13 version. This material has an interior diameter of approximately 1.517 inches, an external diameter of approximately 1.547 inches, and a wall thickness of approximately 0.015 inches. This preferred material is transparent to visible light but substantially opaque to ultra-violet radiation having a wavelength of up to 390 mm. It does not turn yellow with age, to any appreciable degree.

Optionally, sleeve 18 comprises a translucent material having a predominant color, such as gold, red, blue, green, or the like. Whether transparent or translucent, sleeve 18 substantially retains its clarity during extended exposure to ultraviolet radiation and heat produced by the lamp 12.

Additionally, it is preferred that the inner radius of sleeve 18 be slightly larger than the outer radius of lamp 12. Such difference in radii provides a small annular gap C along much of the length of lamp assembly 1. The gap is large enough to permit the bulb to be inserted into the sleeve easily, but small enough to insure adequate dissipation of heat from the bulb.

Adhesive 20 is a high-temperature-resistant adhesive that provides a mechanical seal between the inner surface of sleeve 18 and the outer surface of flange 16. Preferably, adhesive 20 is a soft acrylic pressure-sensitive adhesive. Adhesive 20 also serves as a moisture barrier and assists in preserving an air tight seal.

A particularly advantageous adhesive is provided on a "transfer" tape produced by 3M, Inc. which is available under the designation "969 Tape", a type of "ATG tape". This double-sided adhesive tape is approximately 0.005 inches thick and features an adhesive designated "A-60" which has a very high initial adhesion along with good shear holding power. Adhesive A-60 bonds to most metals and plastics and a variety of other materials. 969 Tape has the further advantages of being clear, and being resistant to ultraviolet light. It has been found that 969 Tape retains its clarity even after extended exposure to light and heat produced by the lamp 12. It is rated as being resistant to temperatures up to 180° over a period of weeks or months.

MANUFACTURING METHOD

The shatter-resistant lamp assembly 1 is made by wrapping the double-sided adhesive tape 20 twice around each of flanges 16 and inserting lamp 12 through sleeve 18 until the ends of the sleeve 18 are substantially aligned with the ends of lamp 12. By wrapping twice, the existence of any gaps in the coverage of the tape can be minimized.

Next, at each end of lamp 12, the portion of sleeve 18 extending over flange 16 is heat-shrunk and compressed to form an adhesive seal between sleeve 18 and flange 16.

The heat-shrinking process preferably comprises applying heat at a temperature of approximately 180° F. to the ends of sleeve 18 for approximately twelve to fifteen seconds. The shrinkage applies moderate pressure sufficient to compress each sleeve end and reduce its diameter to approximately that of the flange 16 plus the thickness of the tape 20.

Since the heat-sealing temperature is relatively low, the sleeve ends shrink but are not believed to melt. This is an advantage in that the sleeve is not weakened by melting a thin spot or a hole through it.

The pressure applied by shrinkage bonds the sleeve ends to the adhesive on the tape 20. Since the adhesive also bonds well to metal, a secure bond and seal is formed at each end of the lamp.

Although it is preferred that the sleeve ends be shrunk by the process, it is not essential. Simple clamping or crimping may be sufficient, depending on the dimensions of the bulb and the flanges 16, the flexibility of the sleeve material, and the type of adhesive used.

Heat-shrinking can be done by slipping a heat-shrinkable plastic collar over each end of the sleeve, applying heat to the collars with a hot-air blower, thus causing both the collars and the sleeve ends to shrink, and removing the collars.

Alternatively and preferably, a heater block is provided with a hole slightly larger than the outside diameter of the flanges 16. The sleeve and one end of the lamp are pushed longitudinally into the hole in the heater block and the block heats the sleeve end to heat-shrink the sleeve end onto the tape. This is done for each end of the lamp assembly.

The foregoing method is amenable to hand-work, full automation, or full or semi-automation.

In an automated or semi-automated production method, at a first station, the tape is separated from the liner material and a strip of tape is wound around each flange and cut. A winding machine (not shown) can be used or the strip can be applied by hand. Alternatively, an even coating of adhesive can be applied all of the way around each flange 16.

Lamp bulbs, with adhesive applied, and sleeves, pre-cut to the proper length, are fed to a second station location where a pusher mechanism (not shown) pushes each bulb into a sleeve. Alternatively, the insertion can be done by hand.

Next, the sleeve-protected bulb is conveyed or carried to a heating fixture which has two spaced-apart heated clamps or heater blocks which receive the sleeve ends and heat-shrink both sleeve ends simultaneously for 12 to 15 seconds. Alternatively, this step also can be done by hand.

After that, the lamp assemblies are packaged for shipment.

Conveyor belts or other conveying equipment can be used to move the lamp assembly parts between stations.

In a typical accident situation, the application of a blow to the lamp assembly 1 may cause the lamp 12 to shatter within sleeve 18. However, sleeve 18 itself will not shatter and will contain the fragments and fluorescent materials of the lamp, thus preventing the escape of contamination outside of the assembly 1.

The shatter-resistant lamp assembly has fewer parts and seams, and has a sleek, seamless look so important to many users.

CURVED LAMP ASSEMBLIES

FIG. 2 is an exploded perspective view showing the three basic components of the curved lamp assembly 30 of the present invention. The assembly includes a U-shaped fluorescent light bulb 32 having metal end caps 38 and 40 and connector pins 42 and 44. Such bulbs are used to provide relatively short lamps with high intensity light output, and save on structural costs in the light fixtures in which they are used.

The assembly 30 also includes a pair of sleeve portions; a lower sleeve portion 34 and an upper portion 36. Each sleeve portion is shaped like the lamp bulb 32 so that it will fit closely around the lamp bulb when assembled together with the other portion of the sleeve.

The sleeve portions 14 and 66 are made of a shatter-resistant plastic sheet material, and preferably are made by injection molding out of a thermoplastic resin such as Polycarbonate, like that of which the sleeve 19 shown in FIG. 1 is made.

As it can be seen in FIG. 3, each sleeve portion 34 and 36 is semi-circular in cross-section. In addition, at each of its two edges, each sleeve portion has a flange. The lower sleeve portion 34 has an outside flange 54 and an inside flange 56. The upper portion 36 has an outside flange 60 and an inside flange 58.

METHOD OF MANUFACTURE

In manufacturing the lamp assembly 30, first the two sleeve portions 34 and 36 are molded to have dimensions so as to form a sleeve slightly larger in diameter than the diameter of the lamp bulb 32.

An adhesive is applied to the metal end caps 38 and 40 of the bulb. Preferably, this is done by wrapping two layers of double-sided adhesive tape 62 (see FIG. 4) around the end caps in the manner described above for the lamp assembly of FIG. 1.

Next, the bulb 32 is placed in the lower sleeve portion 34, and the portion 36 is placed on top of the bulb. The seams are formed around the periphery of the bulb by an adhesive applied to the inside and outside flanges before pressing the flanges together, or by ultrasonic bonding. The ends of the sleeve portion 36 are indicated at 50 and 52, and at 48 and 46 for sleeve portion 34. These end portions are compressed onto the adhesive tape 62 to secure the ends of the sleeve portions to the end caps.

Preferably, the ends of the sleeve portions are compressed by heat shrinking them onto the adhesive tape, as described above in connection with the embodiment shown in FIG. 1.

FIG. 5 is a perspective view of a circular lamp assembly 64 which includes a conventional circular fluorescent lamp bulb 68 with circular sleeve portions 68 and 70 joined at inner and outer seams 72 and 74 formed as described above with reference to FIGS. 2–4. The bulb has end caps 76 and 78 and connector pins 80, as is well known. The sleeve portions are attached to the end caps 76 and 78 in the manner described above in connection with FIGS. 1–4.

The invention thus provides a tightly sealed, highly shatter-resistant envelope around a curved elongated bulb such as a fluorescent bulb. The sleeve formed around the bulb is highly transparent, long-lasting, and stays tightly sealed to prevent the spread of glass shards and other components of the lamp should it become broken.

Although illustrative embodiments of the present invention and modifications thereof have been described in detail herein, it is to be understood that this invention is not limited to these precise embodiments and modifications, and that other modifications and variations may be effected therein by one skilled in the art without departing from the scope and spirit of the invention as defined by the appended claims.

What is claimed is:

1. A shatter-resistant elongated curved lamp assembly comprising, in combination, an elongated lamp bulb having first and second ends, said lamp bulb being curved in its longitudinal dimension, first and second elongated sleeve sections made of a shatter-resistant light-transmitting material, each of said sections having a curvilinear shape matching the shape of said lamp bulb, said sleeve sections being fastened together to form a sleeve having walls enclosing said lamp bulb, said sleeve having first and second ends which are located, respectively, adjacent said first and second ends of said lamp bulb and are secured thereto.

2. An assembly as in claim 1 in which said lamp bulb is U-shaped.

3. A assembly as in claim 1 in which said lamp bulb is circular in shape.

4. An assembly as in claim 1 in which said sections are secured together along a longitudinally-extending seam by means selected from the group consisting of an adhesive and an ultrasonic bond.

5. An assembly as in claim 1 in which each of said ends of said enclosure is secured to one of said ends of said lamp bulb by means of an adhesive.

6. An assembly as in claim 5 in which each of said ends of said enclosure is compressed onto said end of said lamp bulb.

7. An assembly as in claim 5 including at least one layer of double-sided adhesive tape extending around each of said ends of said lamp bulb with each of said ends of said enclosure compressed onto one of said layers of tape.

8. An assembly as in claim 1 in which said lamp bulb has a longitudinal axis and a pair of longitudinal edges, each of said sections is substantially semi-circular in a cross-section taken perpendicular to said longitudinal axis, and has a longitudinally-extending flange at each of said edges being attached to the corresponding flange of the other of said sections.

9. A shatter-resistant elongated curved lamp assembly comprising, in combination, an elongated lamp bulb having first and second ends, said lamp bulb being curved in its longitudinal dimension, said lamp bulb having a U-shape and being substantially cylindrical, first and second elongated U-shaped sleeve sections, each having a semi-circular cross-section and a pair of longitudinally-extending edge flanges and being made of light-transmitting, shatter-resistant material, said sleeve sections being secured together at said flanges to form a sleeve enclosing said lamp bulb, said sleeve having first and second ends, each of which is secured to one of said ends of said lamp bulb and is sealed thereto by means of a double-sided adhesive tape between the sleeve ends and lamp bulb ends.

* * * * *